United States Patent [19]

Yang

[11] Patent Number: 4,651,597

[45] Date of Patent: Mar. 24, 1987

[54] SPEED WRENCH EQUIPPED WITH JAW AUXILIARY OPERATIONAL MECHANISM

[76] Inventor: Tai-Her Yang, 5-1, Tai-Pin Street, Si-Hu Town, Dzan-Hwa, Taiwan

[21] Appl. No.: 640,092

[22] Filed: Aug. 13, 1984

[51] Int. Cl.[4] ..... B25B 13/28

[52] U.S. Cl. ..... 81/77; 81/99

[58] Field of Search ..... 81/98–99, 81/77, 111, DIG. 4, 418, 424.5, 186

[56] References Cited

U.S. PATENT DOCUMENTS

| | | | |
|---|---|---|---|
| 1,576,918 | 3/1926 | Lidell | 81/99 |
| 1,581,915 | 4/1926 | Bradley | 81/77 |
| 2,467,658 | 4/1949 | Cornelli | 81/99 |
| 2,914,979 | 12/1959 | Weinstein | 81/111 |

FOREIGN PATENT DOCUMENTS

| | | | |
|---|---|---|---|
| 1958614 | 5/1971 | Fed. Rep. of Germany | 81/98 |

*Primary Examiner*—Frederick R. Schmidt
*Assistant Examiner*—Debra S. Meislin
*Attorney, Agent, or Firm*—Cushman, Darby & Cushman

[57] ABSTRACT

A speed wrench is equipped with an auxiliary jaw mechanism which can be selectively opened and closed by the action of a control link, thereby allowing the auxiliary jaw mechanism to clamp differently sized workpieces such as a screw nut or bolt. In order to accomplish this function, the speed wrench has a handle, a movable jaw, a movable jaw pin, a closed end wrench jaw, a joiner pin, a plate slidably mounted in a slot in the handle and an element for biasing the plate within the slot.

2 Claims, 33 Drawing Figures

FIG. 10
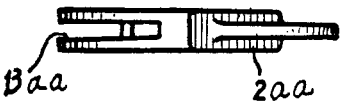
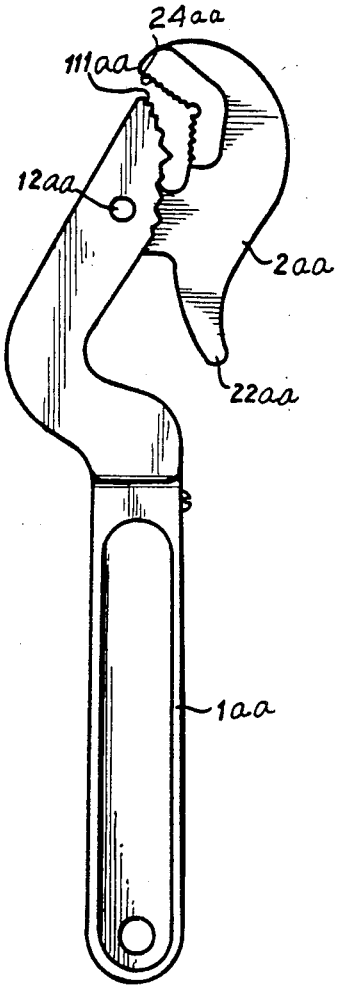
FIG. 8
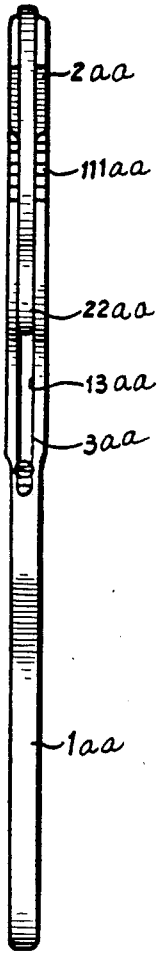
FIG. 9

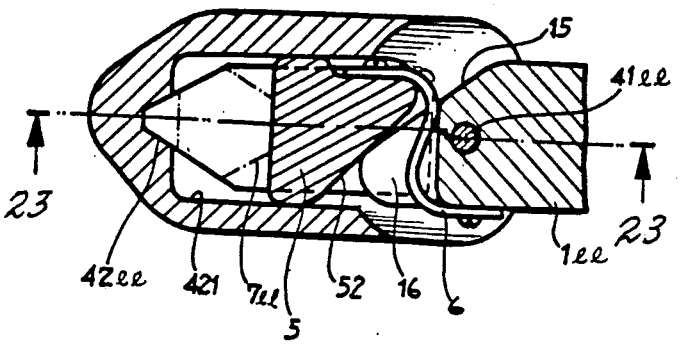
FIG. 22
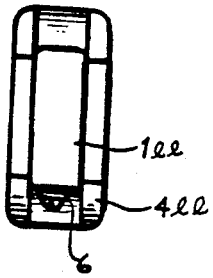
FIG. 24
FIG. 23
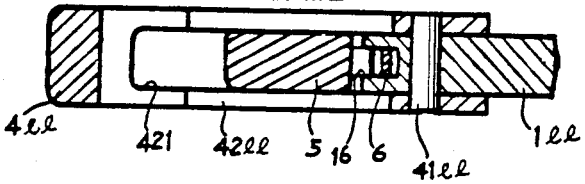
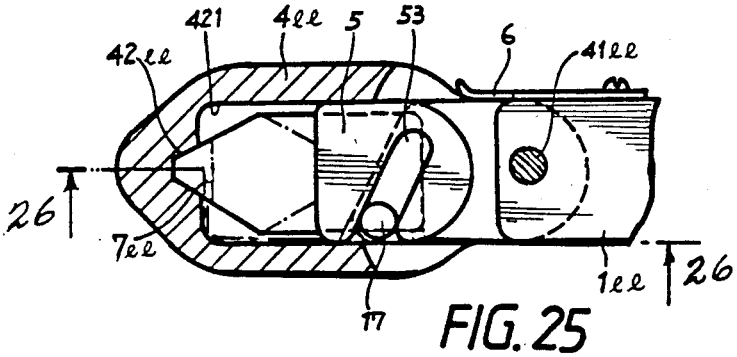
FIG. 25
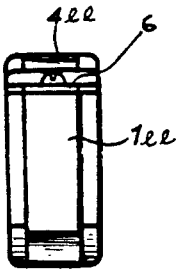
FIG. 27
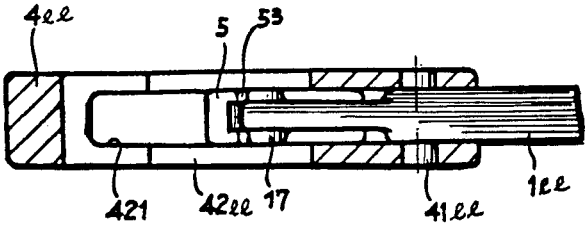
FIG. 26

SPEED WRENCH EQUIPPED WITH JAW AUXILIARY OPERATIONAL MECHANISM

FIELD OF THE INVENTION

The present invention relates to a speed wrench having an operational auxiliary jaw mechanism. The auxiliary jaw mechanism can be selectively opened and closed by the action of a control link to the auxiliary jaw mechanism thereby allowing the auxiliary jaw mechanism to clamp differently sized work pieces such as, for example, a screw nut or a screw bolt.

BACKGROUND OF THE INVENTION

The prior art speed wrench as shown in FIG. 1 comprises a handle 1*a* and movable jaws 1*b* and 1*c* which are placed at two ends of handle 1*a*. The inner edge face of movable jaw 1*b* forms an unsealed polygonal mouth which can match the fixed jaw 1*a'* formed by ends of handle 1*a* so as to clamp various differently sized work pieces such as a screw nut or a screw bolt and execute the locking or releasing work on the work piece. At the central part of the movable jaw 1*c*, there is a hollow polygonal hole. The polygonal hole can match fixed jaw 1*a'* formed by one end of handle 1*a* to permit the tightening or releasing of the speed wrench on the work piece as above mentioned. This kind of speed wrench is more convenient to operate than the usual adjustable wrench. When one uses a conventional speed wrench and applies force to a work piece, the hand of the operator must be used to help adjust the movable jaws 1*b* and 1*c* to fix and clamp the work piece. Thus, the aforedescribed speed wrench is impractical.

An improved speed wrench as shown in FIG. 2 has a spring sheet 2*d* in the axial slot of handle 2*a*. One end of said spring sheet 2*d* is fixed at one side of handle 2*a* while another end pushes against the lower end of movable jaw 2*b*. Due to the tension of said spring sheet (d), the movable jaw 2*b* and the fixed jaw 2*a'* formed by the end of handle 2*a* are matched together to clamp the work piece tightly. This improved speed wrench does not need a helping hand to adjust the movable jaw 2*b* while applying force to the work piece.

However, the design of the speed wrench of FIG. 2 suffers from other disadvantages. At the time movable jaw 2*b* is pressed by the tension from spring sheet 2*d* to the fixed jaw 2*a'* to close the members together, the user must thereafter use his hand to open the movable jaw 2*b* to adjust the movable jaw 2*b* so as to permit the speed wrench to be applied to the work piece. Accordingly, the speed wrench of FIG. 2 is also impractical.

The above described conventional speed wrench devices have essentially the same defects. That is, if a working piece is placed between a gap or when available space is very narrow, it is difficult to fit the speed wrench to the work piece and thereafter apply the desired force or even to adjust the speed wrench to fit the work piece. Thus, the practicality of either of the above-described conventional speed wrenches is limited.

SUMMARY OF THE INVENTION

The present invention provides a speed wrench which possesses a jaw auxiliary operational mechanism. The speed wrench of the present invention includes a press handle at the lower end of the movable jaw along the axial direction. The movable jaw is adjusted by pressing the press handle to produce displacement of the movable jaw to open the mouth defined by the movable jaw and a fixed jaw in order to clamp the work piece therebetween.

Another structural embodiment of the present invention is to provide a speed wrench having a connecting sheet respectively at the lower end of the movable jaw; the two pieces of arc connecting sheet are joined together and positioned in a sliding displacement guide path device to let the operator push and press the two pieces of arc connecting sheet and force the movable jaw to effect a displacement action and permit clamping the working piece.

Furthermore, the inner edge face of the fixed jaw of the present invention is provided with a tooth pattern which is gradually enlarged along the gradually widened swinging trace corresponding to the fixed and locked size in order to adapt to differently sized work pieces so that a firm clamping of the work piece is obtained.

The movable jaw has a multi-sectional displacement and adjustment function. The movable jaw assembly includes an auxiliary jaw which possesses a displaceable driving adjustment function having an automatic return with respect to a polygonally shaped hole for receiving the workpiece to be clamped. In use, the workpiece is fitted within the polygonally shaped hole, force is applied to the speed wrench so that the workpiece is clamped within the polygonally shaped hole. Thus, the force may be applied, as desired, to the workpiece. The movable jaw and the auxiliary jaw assembly return automatically to their original positions after the work piece is removed from the polygonally shaped hole.

BRIEF DESCRIPTION OF THE DRAWINGS

FIG. 8 is a front elevational view of the embodiment as shown in FIG. 7;

FIG. 9 is a side elevational view of the embodiment as shown in FIG. 7;

FIG. 10 is a top elevational view of the embodiment as shown in FIG. 7;

FIG. 22 is a front elevational view of the modification as shown in FIG. 21;

FIG. 23 is a side elevational view of the modification as shown in FIG. 21;

FIG. 24 is a top elevational view of the modification as shown in FIG. 21;

FIG. 25 is a graphic view of the third modification of the embodiment as shown in FIG. 19;

FIG. 26 is a side elevational view of the modification as shown in FIG. 25;

FIG. 27 is a top elevational view of the modification as shown in FIG. 25;

DETAILED DESCRIPTION OF PREFERRED EMBODIMENTS

Figure 4:
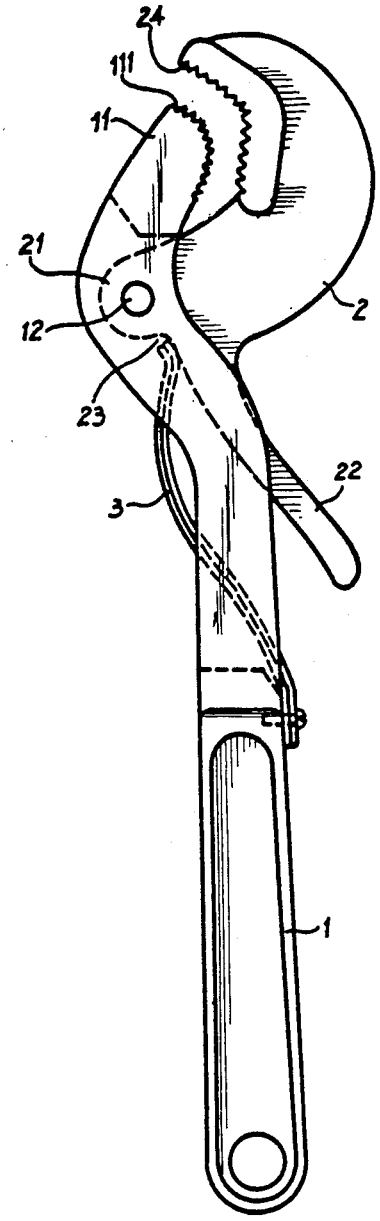
FIG. 4 is a front elevational view of the embodiment as shown in FIG. 3.
Figure 3:
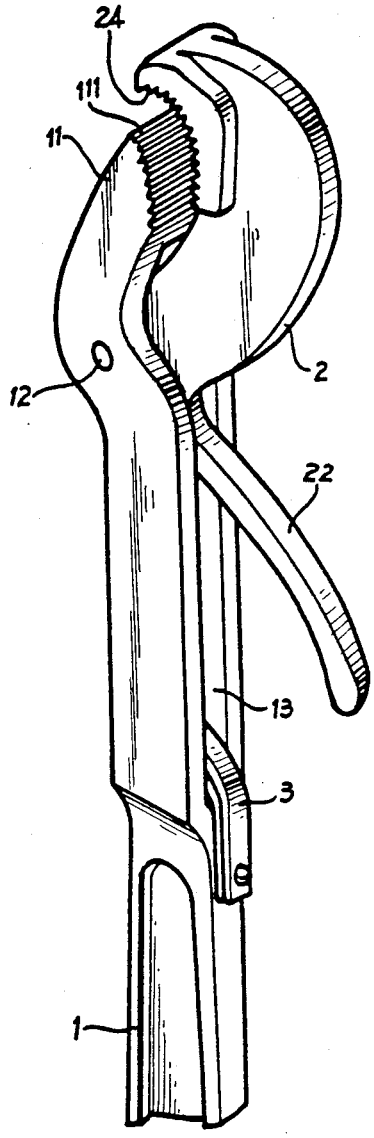
FIG. 3 is a perspective view of the first embodiment of the speed wrench of the present invention.
Figure 6:
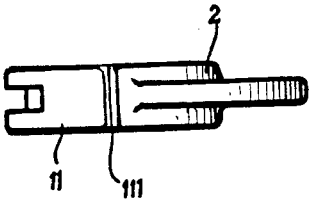
FIG. 6 is a top elevational view of the embodiment as shown in FIG. 3.
Figure 5:
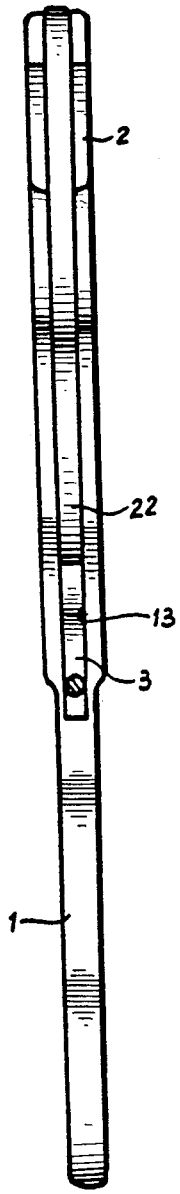
FIG. 5 is a side elevational view of the embodiment as shown in FIG. 3.

A speed wrench of the present invention is illustrated in FIG. 3. The speed wrench of the present invention includes: a handle (1), a fixed jaw (11) and a movable jaw (2), as shown in FIGS. 3 and 4. The main characteristic of the speed wrench of the present invention is that movable jaw (2) is movably joined by a fixing pin (12) in axial slot (13) of handle (1). A spring sheet (3) is provided in the axial slot (13). One end of the spring sheet (3) is fixed at a side edge of the handle (1). The other end pushes against groove (23) (FIG. 4) which is formed between extrusive leg (21) at the lower end of the movable jaw (2) and the press handle (22) which extends along the axial direction. At the side edge face of the movable jaw (2) corresponding to the fixed jaw (11), a tooth pattern (24) is provided. The side edge face of the fixed jaw (11) corresponding to the tooth pattern face (24) is provided with a tooth pattern face as well.

The tension provided by spring sheet (3) is such that the tooth pattern face (24) of the movable jaw (2) and the tooth pattern face (111) of the fixed jaw (11) is such that the jaws (2) and (11) are closed together. In order to separate the tooth pattern face (24) of the movable jaw (2) from the tooth pattern face (111) of the fixed jaw (11), the user will depress the press handle (22) downwardly. As a result, movable jaw (2) pivots about fixing pin (12) such that at least one end of the tooth pattern face (24) moves and swings at least a certain distance in a direction opposite to the depressing force applied to press handle (22). Thus, tooth pattern face (24) is forced to separate from tooth pattern face (111) of the fixed jaw (11) to thereby form a mouth for receiving a work piece to be clamped. The mouth is defined by the thus opened movable jaw (2) and fixed jaw (11). When the workpiece is placed in the thus formed open mouth and the user thereafter releases the pressure applied to the spring sheet (3), the movable jaw (2) automatically closes about the piece to be clamped and worked on, in accordance with the size and configuration of the workpiece. As is evident, two hands are not required to operate the speed wrench of the present invention. After finishing the locking and releasing work, the press handle (22) is pressed down again so as to permit movable jaw (2) to pivot about fixing pin (12) to thereby expand the mouth of the speed wrench whereby the speed wrench may be thereafter released from the workpiece. Afterwards, when the user releases the press handle (22), the movable jaw (2) will automatically return to the original closed position as a result of the tension provided by spring sheet (3).

The speed wrench of the present invention thus provides means for expanding the size of the mouth between movable jaw (2) and fixed jaw (11). The size of the mouth is determined by the distance the movable jaw (2) is displaced from (and with respect to) the fixed jaw (11) as determined by the distance that press handle (22) is depressed by the user. It will thus be apparent that the user may apply force appropriately to press the press handle (22) down according to the size and specification of the clamped screw nut and thus obtain a mouth, defined by movable jaw (2) and fixed jaw (11), properly sized to receive and hold the work piece. When the two tooth pattern faces (24) and (111) of movable jaw (2) and fixed jaw (11) respectively clamp the screw nut tightly, due to the tension of spring sheet (3), the present invention provides a clamping function in order to apply force and operate on a work piece.

Another advantage of this embodiment is that press handle (22) of the movable jaw (2) extends a proper length along the body of the speed wrench in an axial direction so that the user can simply extend the expansion of the mouth to clamp a screw nut which is confined in a narrow space between the jaws (2) and (11).

Figure 7:
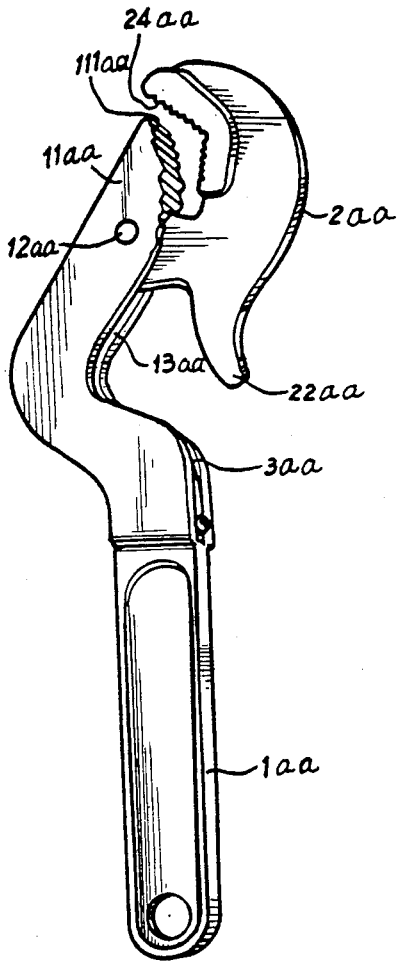
FIG. 7 is a perspective view of the second embodiment of the speed wrench of the present invention.

FIGS. 7 and 8 are graphic views of the second embodiment of the speed wrench of the present invention. The second embodiment of the speed wrench of the present invention is characterized in that the neck at one end of handle **1*aa* which connects to the movable jaw 2*aa* is a bent type which is positioned forwardly of the direction of the force to be applied to the press handle 22*aa*. The press handle 22*aa* is provided at the end of movable jaw 2*aa*. This press handle 22*aa* is designed to be of a shorter length than the press handle 22 shown in FIGS. 4–7. The neck of handle 1*aa* is a bent type so as to permit a larger displacement of the press handle 22*aa* when press handle 22*aa* is pressed downwardly towards the body of the speed wrench. In this embodiment, the mouth is defined between movable jaw 2*aa* and fixed jaw 11*aa***. The mouth can be expanded to receive larger workpieces in this embodiment.

Figure 1:
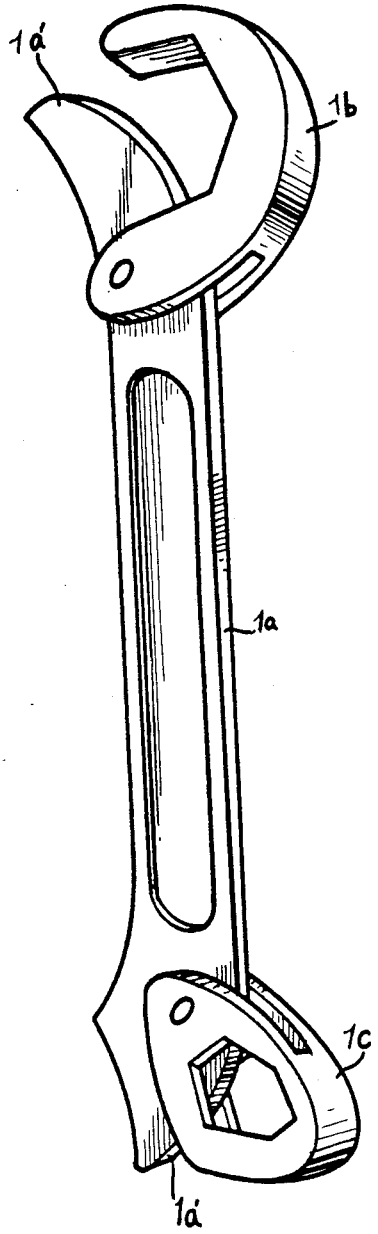
FIG. 1 (PRIOR ART)
FIG. 1 is a graphic view of the first structure of the conventional speed wrench.
Figure 2:
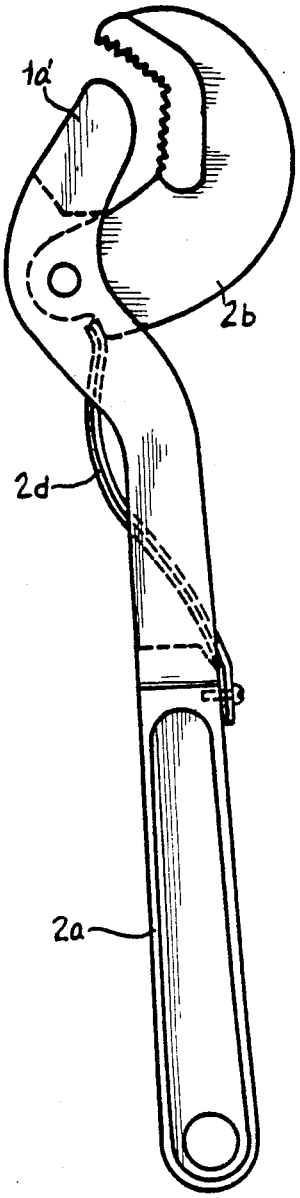
FIG. 2 (PRIOR ART)
FIG. 2 is a graphic view of the second structure of the conventional speed wrench.
Figure 11:
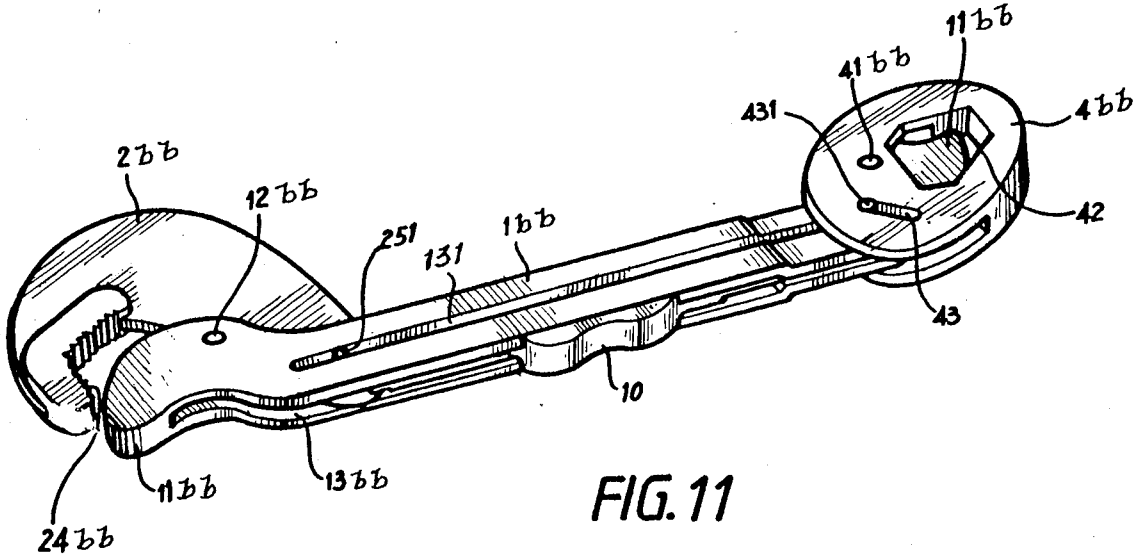
FIG. 11 is a perspective view of the third embodiment of the speed wrench of the present invention.
Figure 12:
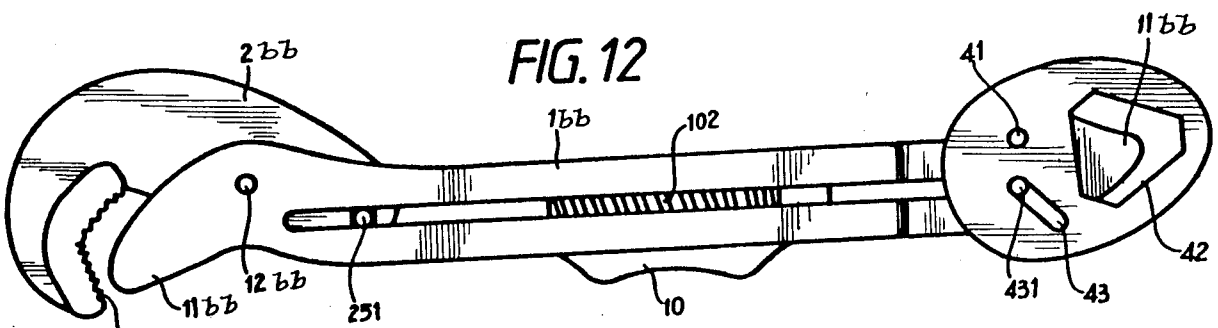
FIG. 12 is a front elevational view of the embodiment as shown in FIG. 11.
Figure 13:
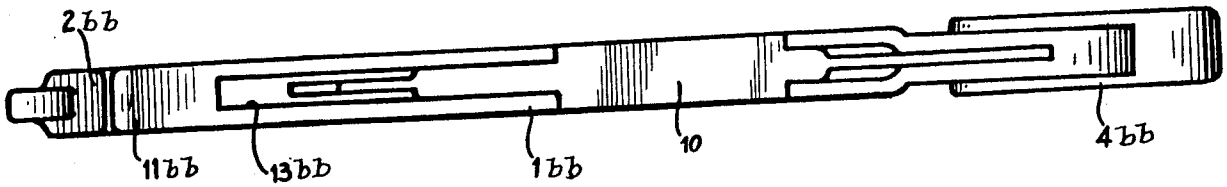
FIG. 13 is a side elevational view of the embodiment as shown in FIG. 11.

FIGS. 11 and 12 are graphic views of the third embodiment of the speed wrench of the present invention. The speed wrench of the present invention differs from the structure of the conventional wrench (FIG. 1) and is an improvement thereover. The main characteristic of the speed wrench of the third embodiment is that two ends of handle **1*bb* (FIG. 12) are respectively and movably joined by a movable jaw 2*bb* and a sealed type movable jaw 4***bb* in an axial slot 43. In such an arrangement, the movable jaw 2*bb* is as shown in FIGS. 3 and 7. The movable jaw 4*bb* is a sealed type. At the central portion of the sealed movable jaw 4*bb*, there is a hollow polygonally shaped hole (42). The two ends of handle 1*bb* respectively form fixed jaw 11*bb*, and respectively match movable jaw 2*bb* and the sealed movable jaw 4*bb* so as to permit these jaws to operate in conjunction with one another.

Figures 11A, 11B:
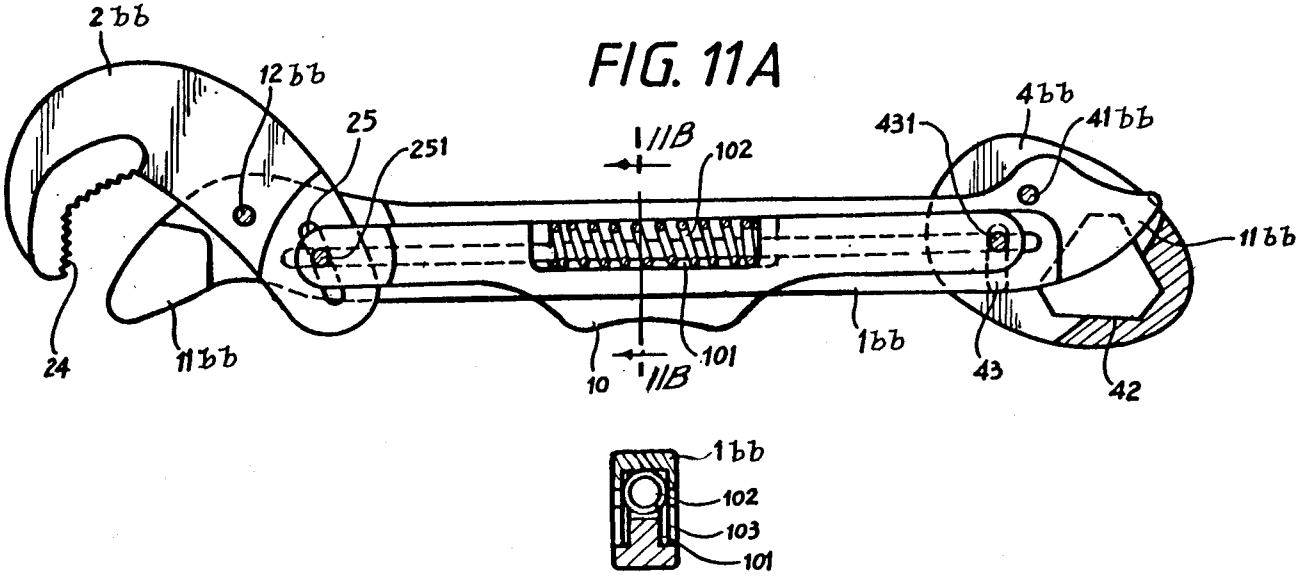
FIG. 11A is a longitudinally exploded view of FIG. 11.
FIG. 11B is a transversely exploded view of FIG. 11.
Figure 14:
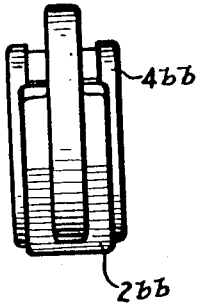
FIG. 14 is a top elevational view of the embodiment as shown in FIG. 11.

In FIG. 11, joiner pin 431 is shown as the means for engaging the spring plate 10 (biased by spring 102 in pocket 101 in FIGS. 11A and 11B) so as to provide means for moving the sealed movable jaw 4*bb*. Sealed movable jaw 4*bb* has slot 43 for receiving joiner pin 431. Pin 41 holds the sealed movable jaw 4*bb* in a pivotable relationship with the handle 1*bb*. Movable jaw pin 251 is shown as the means for engaging the spring plate 10 so as to provide means for selectively moving the movable jaw 2*bb* with respect to the fixed jaw 11*bb*. The movable jaw 2*bb* is pivotably mounted to handle 1*bb* by movable jaw pin 12*bb*. Movable jaw 2*bb* is pivotably mounted to handle 1*bb* to movable jaw pin 12*bb*. Movable jaw 2*bb* has slot 25 for receiving movable jaw pin 251 shown in FIG. 11A. Pins 251 and 431 also slide in slot 131 which is longitudinally aligned in the handle 1*bb*.

Figure 15:
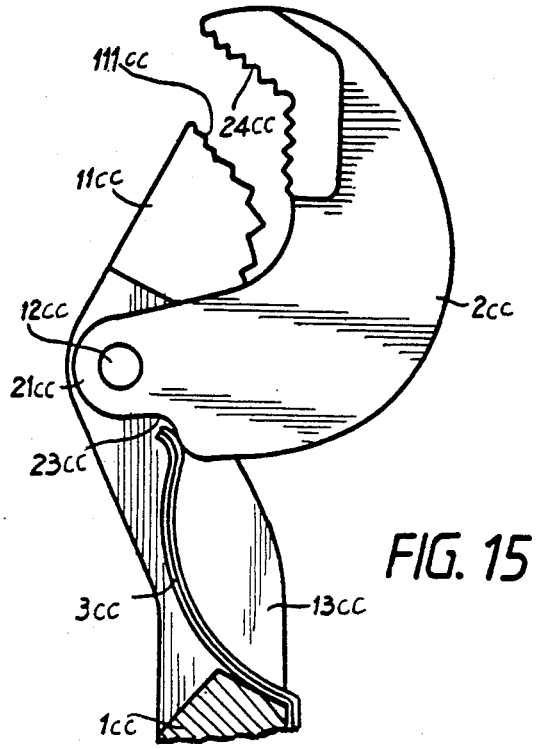
FIG. 15 is a fourth embodiment of the speed wrench of the present invention in which an inner edge face of the fixed jaw possesses a gradually enlarged tooth pattern.

FIG. 15 is a graphic view of a fourth embodiment of the speed wrench of the present invention in which tooth pattern face 111*cc* of fixed jaw 11*cc* possesses a gradually enlarged tooth pattern. This fourth embodiment is characterized in that the tooth pattern on the tooth pattern face 111*cc* of the fixed jaw 11*cc* is gradually enlarged according to a variety of sizes which correspond to the swinging trace of movable jaw 2*cc* in order to match various working pieces having different configurations and sizes so as to provide a stable and firm clamping function.

Figure 18:
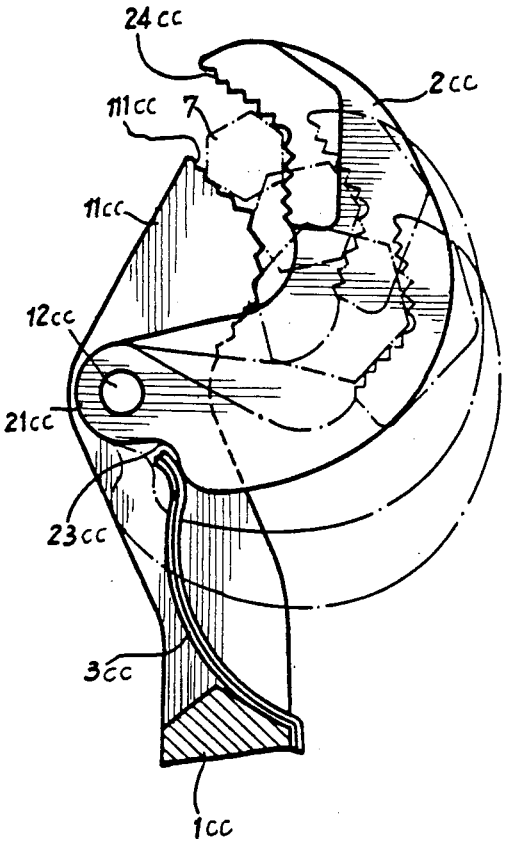
FIG. 18 is a graphic view of the operation of the embodiment as shown in FIG. 15.

FIG. 18 is a graphic view of a first modification of this embodiment in which the mouth defined between movable jaw 2*cc* and fixed jaw 11*cc* can produce a firm and stable clamping function on working piece (7) as provided in part by a gradually enlarged tooth pattern on face 111*cc* of fixed jaw 11*cc*.

Figure 16:
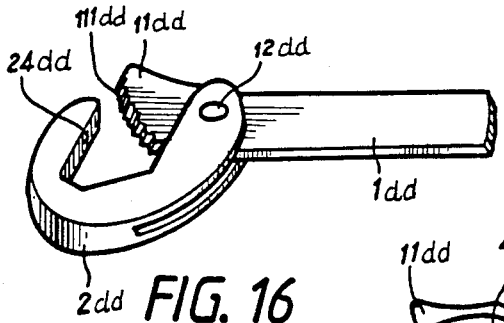
FIGS. 16 and 17 are graphic views of a fifth embodiment as shown in FIG. 15.
Figure 17:
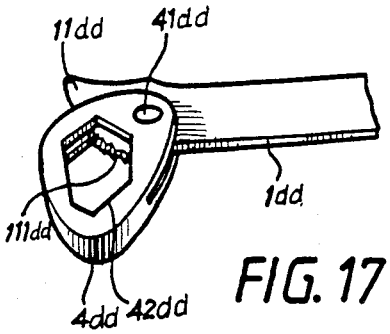

FIGS. 16 and 17 illustrate a fifth embodiment of the present invention. FIGS. 16 and 17 illustrate two different ends of the fifth embodiment, each end possessing a clamping function analogous to that provided by the fourth embodiment shown in FIGS. 15 and 18. In FIG. 16, the clamping function is provided with respect to unsealed movable jaw 4*dd*.

Figure 20:
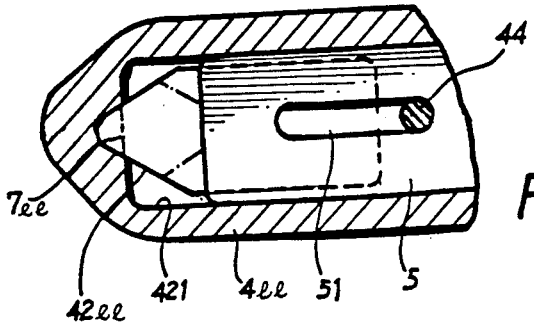
FIG. 20 is a front elevational view of the modification as shown in FIG. 19.
Figure 19:
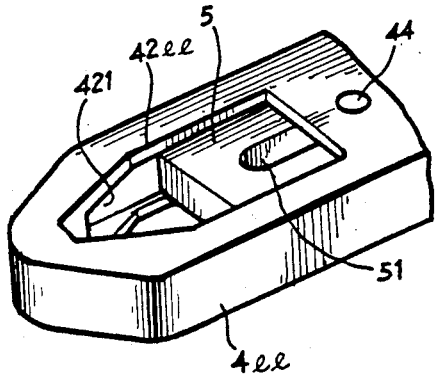
FIG. 19 is a perspective view of the first modification of the sixth embodiment of the speed wrench of the present invention in which the movable jaw possesses a displaceable and adjustable auxiliary jaw.

FIGS. 19 and 20 are graphic views of a sealed movable jaw 4*ee* of a speed wrench in a sixth embodiment of the present invention. An adjustable auxiliary jaw (5) is assembled in a hollow polygonal hole 42*ee* and travels in a guide groove (421). The auxiliary jaw (5) is movably joined at sealed movable jaw 4*ee* by inserting a setting pin (44) through long hole (51) in guide groove 421 of polygonal hole 42*ee*. The long hole (51) can provide the auxiliary jaw (5) with a movably adjusting displacement distance. An advantage of this embodiment is that the user can adjust the position of auxiliary jaw (5) to clamp a working piece 7*ee* having different sizes.

Figure 21:
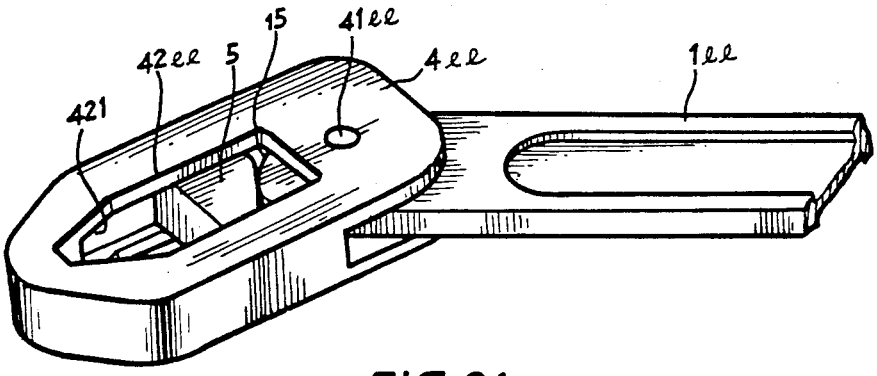
FIG. 21 is a graphic view of the second modification of the embodiment as shown in FIG. 19.

The position of the adjustable auxiliary jaw (5) can be adjusted by the present invention with the user's hand. But, after finishing work, the jaw (5) cannot automatically return to its original position. Structure as shown in FIGS. 21 and 22 is a mofidication of auxiliary jaw (5) which can adjust the position and return the jaw (5) to its original position automatically. The side of auxiliary jaw (5) corresponding to the end of handle 1*ee* is an incline (52), and the other end of handle 1*ee* also possesses an incline (15). A bent spring (6) is provided at one end of incline (15). One end of the spring sheet is fixed and locked at the upper side edge face of the end of the handle 1*ee* through a vertical slot (16). When the handle 1*ee* applies force along the direction of the arrowhead, the incline (15) at the handle end and the incline (52) of the auxiliary jaw (5) will produce a displacement to let auxiliary jaw (5) move in the direction of the dotted arrowhead so as to permit a clamping action about the working piece 7*ee*. At this time, due to the displacement of auxiliary jaw (5), bent type spring sheet (6) is under tension and is extended. After releasing or locking the working piece 7*ee*, the handle 1*ee* is wrenched toward the opposite direction of the arrowhead. The auxiliary jaw (5) can automatically return to the original position by the biasing action provided by spring sheet (6).

FIG. 25 illustrates another structural design of an auxiliary jaw (5) which can adjust its position and return to the original position automatically. A guide groove (53) having an inclined angle is provided at the end face of the auxiliary jaw (5). At the end of handle 1*ee*, there is a setting pin (17). The setting pin (17) penetrates the guide groove (53) so as to join with auxiliary jaw (5). The side face of the end of the handle 1*ee* is fixed and locked into place by a screw at one end of spring sheet (6). Another end of spring sheet (6) presses the side edge of sealed movable jaw 4*ee*. When force is applied to handle 1*ee* and the handle 1*ee* is wrenched in the direction of the arrowhead, the setting pin (17) at its end is displaced towards the upper part of guide groove (53), due to guide groove (53) having an inclined angle. Consequently auxiliary jaw (5) is displaced towards the direction of the dotted arrowhead so as to provide a clamping action on the working piece 7*ee*. On the other hand, when handle 1*ee* is wrenched in the opposite direction of the arrowhead, the setting pin (17) will move to the original position along the guide groove (53), and will simultaneously drive auxiliary jaw (5) back to the original position toward the opposite direction of the dotted arrowhead. While the speed wrench of this embodiment is used to apply force to a work piece 7*ee*, it will be seen that the main function of the spring sheet (6) in the embodiment is to produce pressure on the sealed movable jaw 4*ee* so that the force to be transmitted will be smoothly applied to the work piece 7*ee*.

Figure 28:
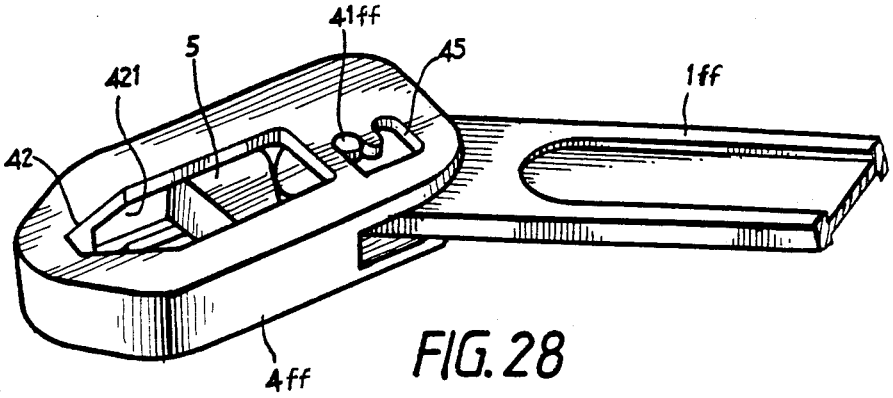
FIG. 28 is a graphic view of the seventh embodiment of the speed wrench of the present invention in which the movable jaw possesses a multi-sectional displacing and adjusting structure.
Figure 29:
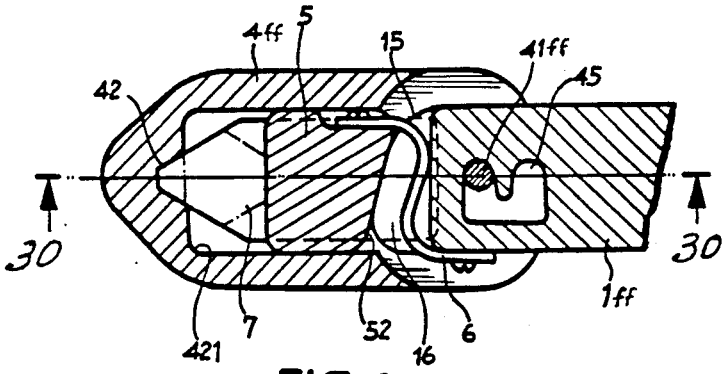
FIG. 29 is a front elevational view of the embodiment as shown in FIG. 28.
Figure 30:
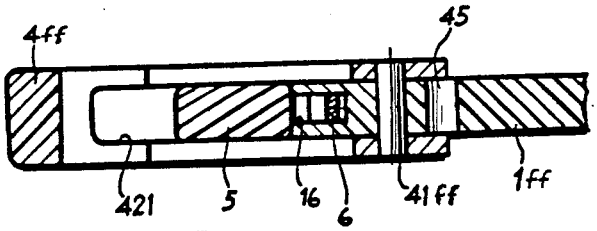
FIG. 30 is a side elevational view of the embodiment as shown in FIG. 28.
Figure 31:
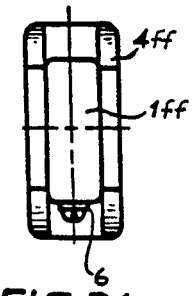
FIG. 31 is a top elevational view of the embodiment as shown in FIG. 28.

FIG. 28 illustrates a speed wrench constituting a seventh embodiment of the present invention in which the sealed movable jaw possesses a multi-sectional position adjusting structure. In this illustrated embodiment, at the point where the sealed movable jaw 4*ff* and the handle 1*ff* are movably joined together, a multi-sectional joint groove (45) is provided. The setting pin is provided between the handle 1*ff* and sealed movable jaw 4*ff*. The setting pin 41*ff* can change its placement position as required, in order to change the position of sealed movable jaw 4*ff*. Another embodiment of the multi-sectional position adjusting structure is illustrated in FIG. 29 and is applied on the structure as shown in FIG. 22.

The foregoing preferred embodiments are considered illustrative only. Numerous other modifications and changes will readily occur to those persons skilled in the pertinent art. Consequently, the disclosed invention is not limited to the exact structure and methods of operation shown and described hereinabove.

I claim:

1. A speed wrench comprising:

a handle having a first longitudinally aligned slot in a side face thereof and having a second longitudinally slot in an edge thereof, said handle also having a first end and a second end, said first end terminating in a fixed jaw and said second end terminating in a tooth-like projection;

a movable jaw pivotably mounted to said first end of said handle such that said movable jaw is in confronting but opposing relationship to said fixed jaw and having a base end configured to be received within said second longitudinally aligned slot, said base end of said movable jaw having a movable jaw slot;

a movable jaw pin in slidable engagement with said movable jaw slot and said first longitudinally aligned slot;

a closed end wrench jaw having a polygonally shaped opening therein and a base edge, said base edge having a base edge slot therein for receiving said second end of said handle, said closed end wrench jaw pivotably mounted to said handle about said second end of said handle such that said projection of said second end is extendable through said base edge slot into said polygonally shaped opening, said closed end wrench jaw having a joiner slot;

a joiner pin in slidable engagement with said first longitudinally aligned slot and said joiner slot;

a plate slidably mounted in said second longitudinally aligned slot in said handle, said plate having a first plate end, said first plate end having means for receiving said movable jaw pin, said plate having a second end, said second plate end having means for receiving said joiner pin; and means for biasing said plate within said second longitudinally aligned slot.

2. Speed wrench according to claim 1, wherein said fixed jaw has raised ridges.

* * * * *